US006119418A

United States Patent [19]

Johnson

[11] Patent Number: 6,119,418

[45] Date of Patent: Sep. 19, 2000

[54] PRE-STRESSED BUILT-UP INSULATED CONSTRUCTION PANEL

[76] Inventor: David Johnson, P.O. Box 6095, Peace River, Alberta, Canada, T8S 1S1

[21] Appl. No.: 09/026,234

[22] Filed: Feb. 19, 1998

[30] Foreign Application Priority Data

Feb. 24, 1997 [CA] Canada ..... 2198310

[51] Int. Cl.[7] ..... E04C 2/00; E04C 5/08

[52] U.S. Cl. ..... 52/223.7; 52/309.4; 52/309.7; 52/89; 52/91.1; 52/91.3; 52/609

[58] Field of Search ..... 52/223.6, 223.7, 52/309.4, 309.7, 309.16, 83, 89, 91.1, 91.3, 608, 609, 223.9

[56] References Cited

U.S. PATENT DOCUMENTS

| | | | |
|---|---|---|---|
| 312,375 | 2/1885 | Orr | 52/223.7 |
| 2,665,387 | 1/1954 | Bartow | 52/592.1 X |
| 3,295,269 | 1/1967 | Schuster | 52/223.7 X |
| 4,284,094 | 8/1981 | Behrend | 52/86 X |
| 4,320,603 | 3/1982 | Kirschen . | |
| 4,425,740 | 1/1984 | Golden . | |
| 4,577,447 | 3/1986 | Doran . | |
| 4,644,710 | 2/1987 | Lippe | 52/223.7 X |
| 4,727,696 | 3/1988 | Henriques De Trindade | 52/223.7 |
| 4,890,437 | 1/1990 | Quaile | 52/690 |
| 5,218,801 | 6/1993 | Hereford | 52/223.9 |
| 5,323,573 | 6/1994 | Bakewell, III | 52/223.7 X |
| 5,488,806 | 2/1996 | Melnick . | |
| 5,809,713 | 9/1998 | Ray | 52/223.7 X |

FOREIGN PATENT DOCUMENTS

| | | | |
|---|---|---|---|
| 533147 | 2/1922 | France | 52/89 |

OTHER PUBLICATIONS

WeB Site http://www.newciv.org/GIB/reinv/RIS–39.hTML Plastic Polytunnels for Housing by Andrew Layton, Dec. 2, 1996 printout.

*Primary Examiner*—Laura A. Callo
*Attorney, Agent, or Firm*—Bennett Jones LLP

[57] ABSTRACT

A construction panel is formed of a plurality of elongate subpanels where each subpanel comprises a plurality of expanded polystyrene blocks placed end to end. Tensioning cables pass over the inner and outer surfaces of the subpanels between tensioning plates positioned at each end of the subpanels. Tensioning the cables imparts longitudinal compression in the subpanels, such that the blocks of the subpanels act monolithically. The inner and outer surfaces of the subpanels are longitudinally convex. The panel may be corrugated. The subpanels may be interlocking to form the construction panel.

8 Claims, 10 Drawing Sheets

PRE-STRESSED BUILT-UP INSULATED CONSTRUCTION PANEL

FIELD OF THE INVENTION

The present invention relates to a construction panel for use in building walls and roofs.

BACKGROUND OF THE INVENTION

Traditional building construction of wood, concrete and/or steel can be relatively expensive and time-consuming to erect. It is sometimes desirable to quickly erect a building at a minimal cost. One alternative in the prior art are so-called "polytunnels" which are simply fabric covered frames creating a semi-circular enclosed space. Polytunnels are often used as temporary structures to provide protection from the elements but are not usually considered permanent. Polytunnels suffer from further disadvantages in that they do not possess high structural strength, provided limited insulative opportunity and have limited useable space as a result of the semi-circular design.

Therefore, a need exists for a low-cost building alternative to traditional wood, concrete and/or steel structures which has an adequate degree of permanence and structural strength. It would be further advantageous if such an alternative included the use of insulating materials to obviate the need to apply separate insulation and allowed for simple and fast construction.

SUMMARY OF THE INVENTION

In one aspect of the invention, the invention is a construction panel for use in a building structure, the panel having a longitudinal dimension and a lateral dimension and comprising a plurality of sub-panels, each sub-panel having a first end and a second end separated by said longitudinal dimension, and comprising:

(a) a plurality of blocks aligned longitudinally and abutting one another; and (b) stressing means associated with each sub-panel for maintaining the blocks in longitudinal alignment and for creating a longitudinal compressive force in the sub-panel causing the sub-panel to act monolithically;

wherein the sub-panels are arranged and abut one another laterally, and wherein each sub-panel has a convex outer surface and a convex inner surface, the convexity of said surfaces being apparent when the sub-panel is viewed laterally in cross-section.

In the preferred embodiment of the invention, the stressing means comprises, in association with each sub-panel, an outer cable and an inner cable passing in longitudinal orientation along the outer and inner surfaces respectively of the sub-panel, the cables extending between and being anchored to anchor frames associated with the first and second ends of the sub-panel, and both cables are tightened.

The subpanels preferably interlock with each other; therefore, the subpanels may comprise blocks each comprising a projection member, a body and a channel in the body shaped to receive the projection of a laterally adjacent block whereby each subpanel interlocks with the adjacent subpanel or subpanels. A cable groove may be formed on the outer and inner surfaces of each subpanel, which groove overlaps the projections of one subpanel and the body of the adjacent subpanel such that the stressing means assists in attaching one subpanel to the immediately adjacent subpanel or subpanels.

In another aspect of the invention, the invention comprises a construction panel having a longitudinal dimension and a lateral dimension, and having a first end and a second end separated by said longitudinal dimension, said panel comprising:

(a) a plurality of blocks fitted together to form the panel;

(b) wherein each block is shaped such that the panel, when viewed laterally in cross-section, has a convex outer surface and a convex inner surface;

(c) at least two anchor plates associated with said first and second ends of the panel: and (d) a plurality of tensioned cables running longitudinally along said outer surface and inner surface;

wherein the panel acts monolithically as a result of a compressive force in the panel created by the tensioned cables and the interlocking blocks.

The blocks may be substantially aligned in longitudinal rows where each row interlocks with the immediately adjacent row or rows and the tensioned cables are located in the area of overlap between two adjacent rows.

DESCRIPTION OF THE PREFERRED EMBODIMENT

The present invention is a building construction system which comprises a building panel (10) which is particularly useful in constructing a roof but which may also be used to construct walls. The following description is in reference to a preferred embodiment for a roof panel having the approximate dimensions of 100 feet wide by 30 feet in height. Of course, the invention may be practised on a scale smaller or larger than this with the appropriate variations in all other dimensions.

Figure 1:
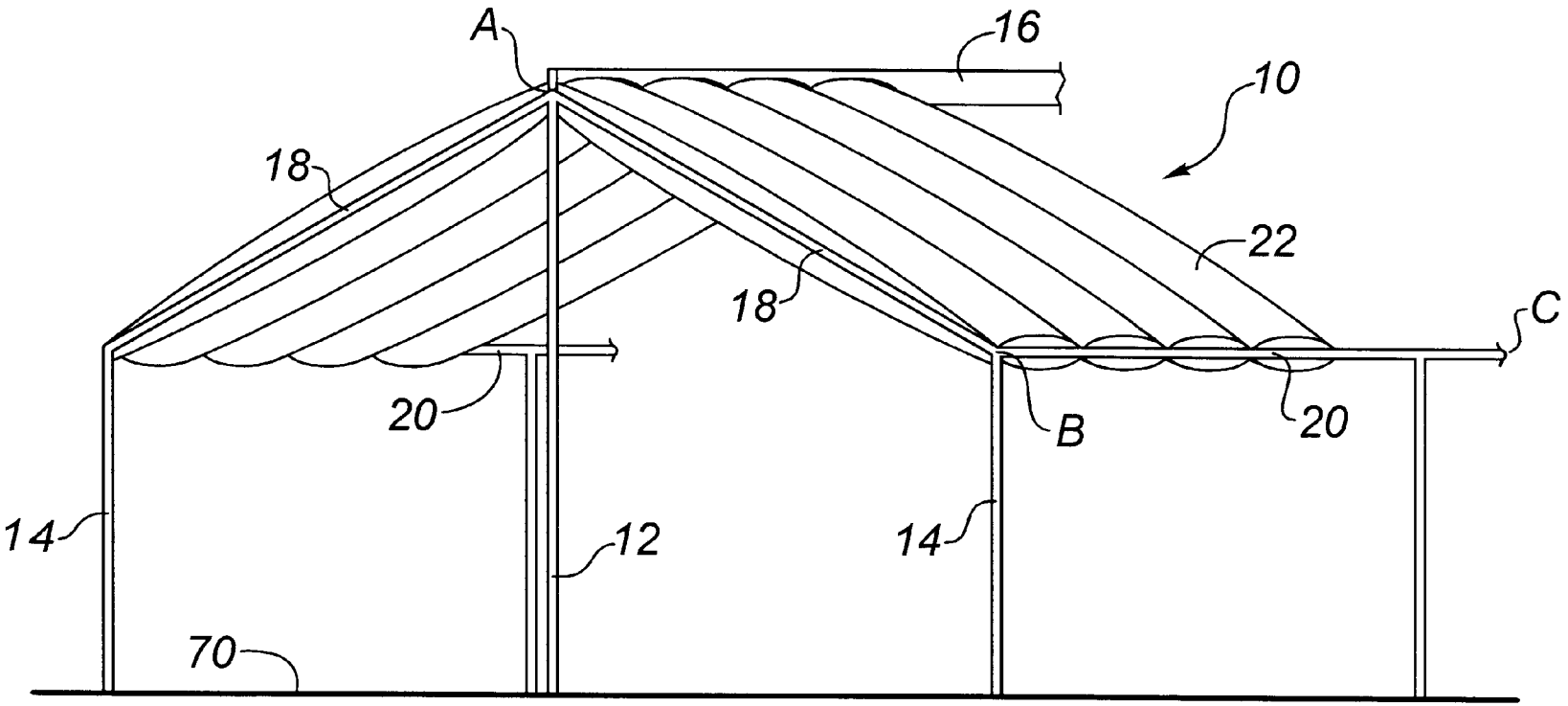
FIG. 1 is a view of a preferred embodiment of the invention.

As shown in FIG. 1, a building frame is constructed of conventional structural members: upright center support posts (12), corner support posts (14), an apex beam (16), end beams (18) and lower roof beams (20). The construction of the frame may be by any known or conventional techniques; the only consideration important to the present invention is that the frame be sufficiently strong to support the entire structure, including the forces created by the tensioned cables as described further below.

In this specification, the term "roof plane" shall mean the plane defined by points A, B and C in FIG. 1. A vertical axis shall mean any axis on the roof plane and parallel to axis A-B. A horizontal axis shall mean any axis on the roof plane and parallel to axis B-C.

The roof panel (10) is comprised of a plurality of subpanels (22) which are elongated vertically and abut each horizontally. The roof panel (10) is attached to the end beams (18), the lower roof beam (20) and the apex beam (16) in a manner that is further described herein.

Figure 2:
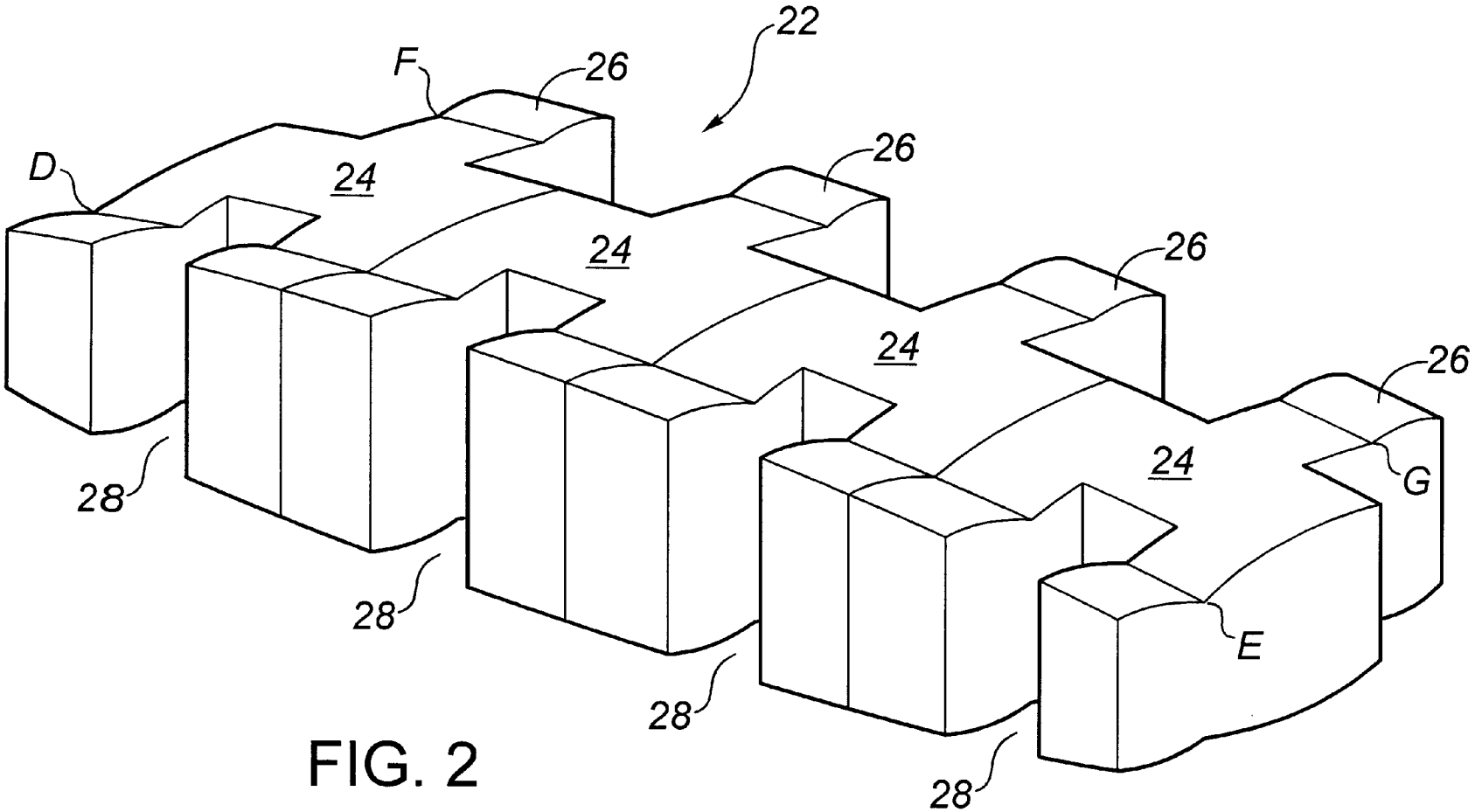
FIG. 2 is a view of a portion of a subpanel of the embodiment of FIG. 1.

In the preferred embodiment and as shown in FIG. 2, each subpanel (22) is comprised of a plurality of blocks (24) aligned and abutting one another along a vertical axis. The blocks (24) are approximately 6 feet square in the preferred embodiment. Each block (24) is individually shaped resulting in the subpanel (22) having a cambered upper surface and a cambered lower surface. The camber follows a line D-E which is substantially normal to a horizontal axis. The degree of camber is illustrated by the thicknesses of the blocks (24); the thickest blocks in the middle may be 18 inches thick while the thinnest blocks at the ends of the subpanel may be 8 inches thick. Such thickness is measured on an axis normal to the roof plane.

The blocks (24) are preferably made of a lightweight, low-density material. Expanded polystyrene is ideal and has the additional advantages of high compressive strength, low water absorption and high thermal resistance.

Figure 3:
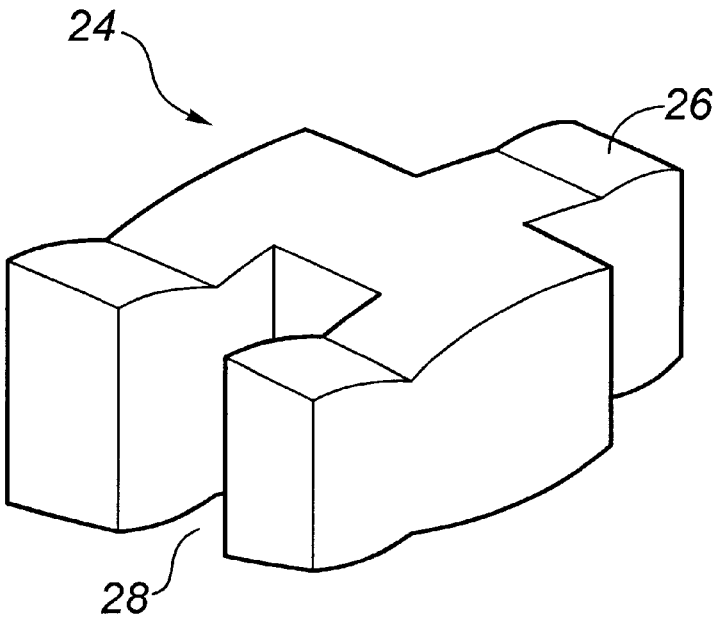
FIG. 3 is a view of a block of the subpanel of FIG. 2.

It is preferable that each subpanel (22) interlock with adjoining subpanels (22) in order to provide additional structural strength to the roof panel (10). As shown in FIGS. 2 and 3, this is accomplished by a series of projections (26) and corresponding channels (28) on the sides of subpanels (22) which abut adjoining subpanels. It is convenient to make each individual block (24) interlock with its neighbour in the adjoining subpanel. As may be obvious, the end subpanels (22) or those which abut the end beams will have only projections or only channels as the case may be.

Figure 5:
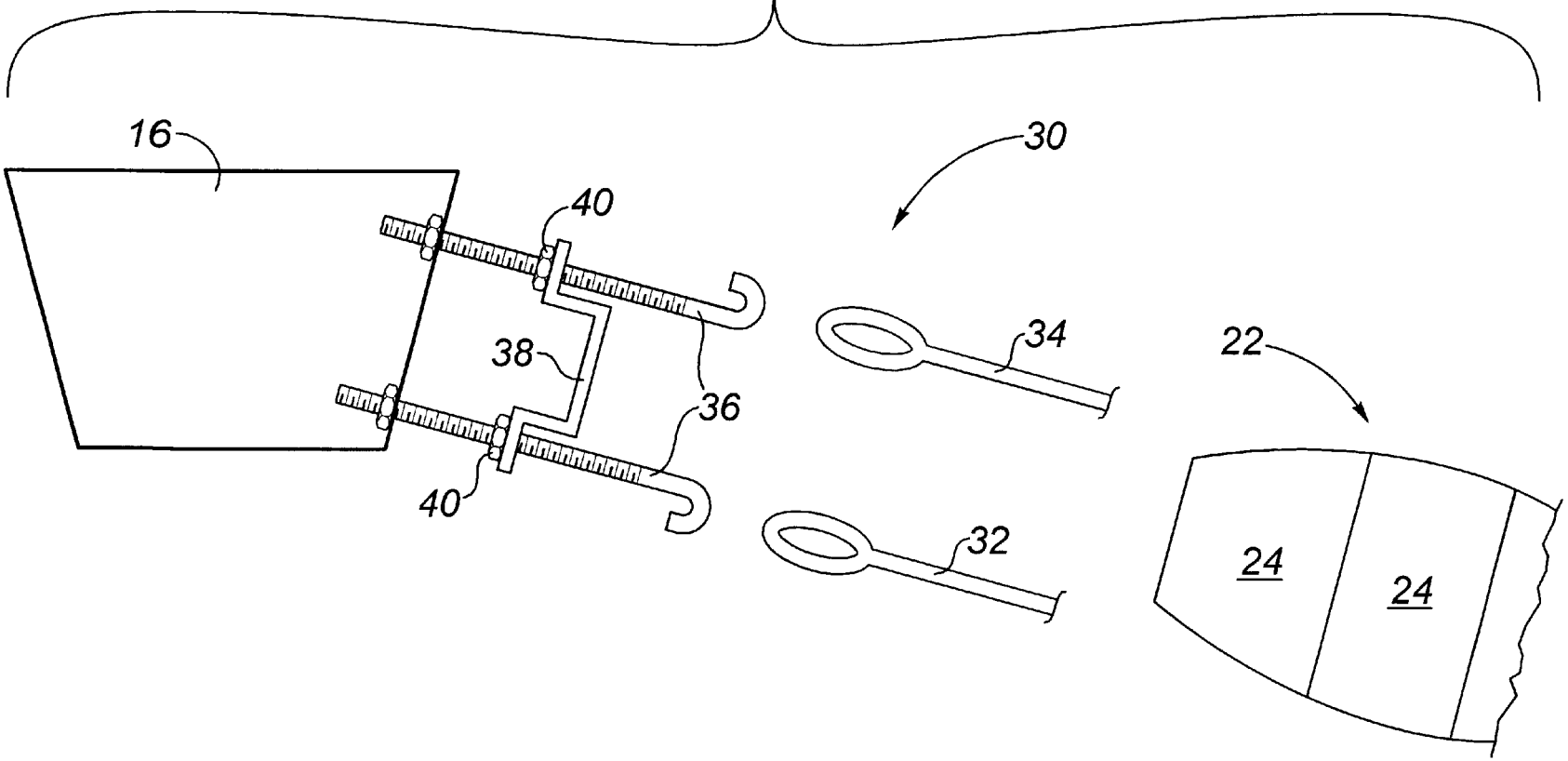
FIG. 5 is a cross-sectional exploded view of the apex beam and tensioning means of the preferred embodiment.

Although it is possible to attach the blocks to one another with glue or other suitable means, it is unnecessary to do so. In the preferred embodiment, the subpanel (22) is made to act monolithically by means of stressing means (30). The stressing means (30) comprises a series of inner cables (32) and outer cables (34) which run along camber lines on the upper and lower surface of the roof panel (10), tensioning hooks (36) and tensioning plates (38). As shown in FIG. 5, the cables (32, 34) are looped over the hooks (36) which pass through the tensioning plate (38) and attach to the apex beam (16) at one end and the lower roof beam (20) at the other end. In the preferred embodiment, the apex and lower roof beams (16, 20) are manufactured to have angled sides which are perpendicular to the roof plane so that the tensioning plates (38) have a parallel surface to attach to.

The tensioning hooks (36) have a threaded portion which allows the cables (32, 34) to be tightened by tightening a nut (40) threaded onto the hook (36). When tightened, the cables (32, 34) create a force compressing the blocks (24) together. This squeezing of the blocks (24) causes the subpanel (32) to act monolithically despite being comprised of separate blocks.

It is further preferable if the camber lines followed by the cables (32, 34) cross portions of adjoining subpanels (22). Therefore, in the preferred embodiment, the cables run along the roof panel (10) in the zones where one subpanel overlaps with another. Placement of each cable is facilitated by a groove formed in each subpanel along the camber line. The grooves are illustrated in FIG. 2 as following lines D-E and F-G. The roof panel (10) will therefore have a corrugated appearance as shown in FIG. 1.

Figure 6:
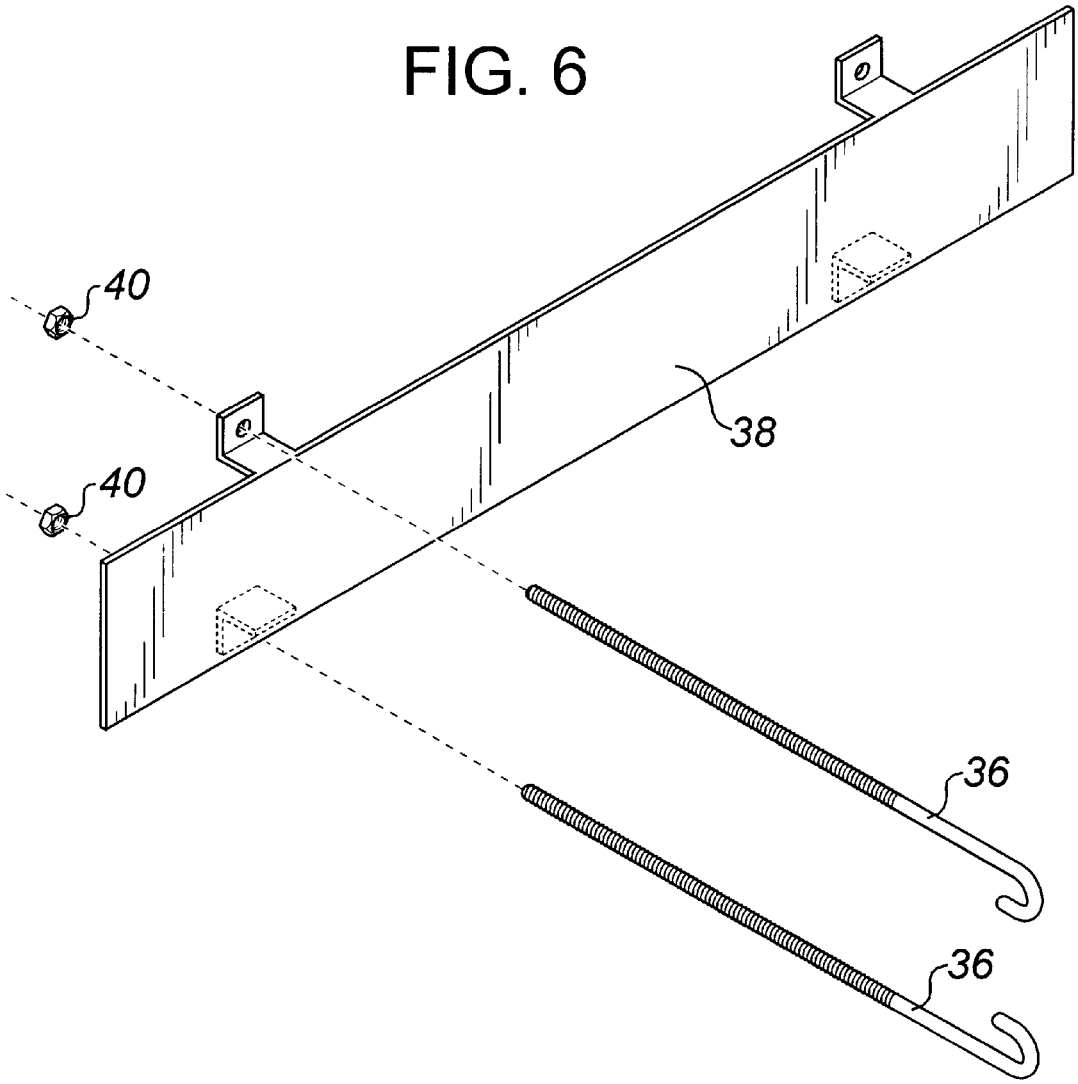
FIG. 6 is a view of the tensioning plate and hooks.

Each tensioning plate (38), shown in FIG. 6, is approximately 12 feet long which is sufficient to tension two subpanels (22). The cables (32, 34) are preferably wire rope; however, any rope or cable having substantial tensile strength may be used.

Figure 4:
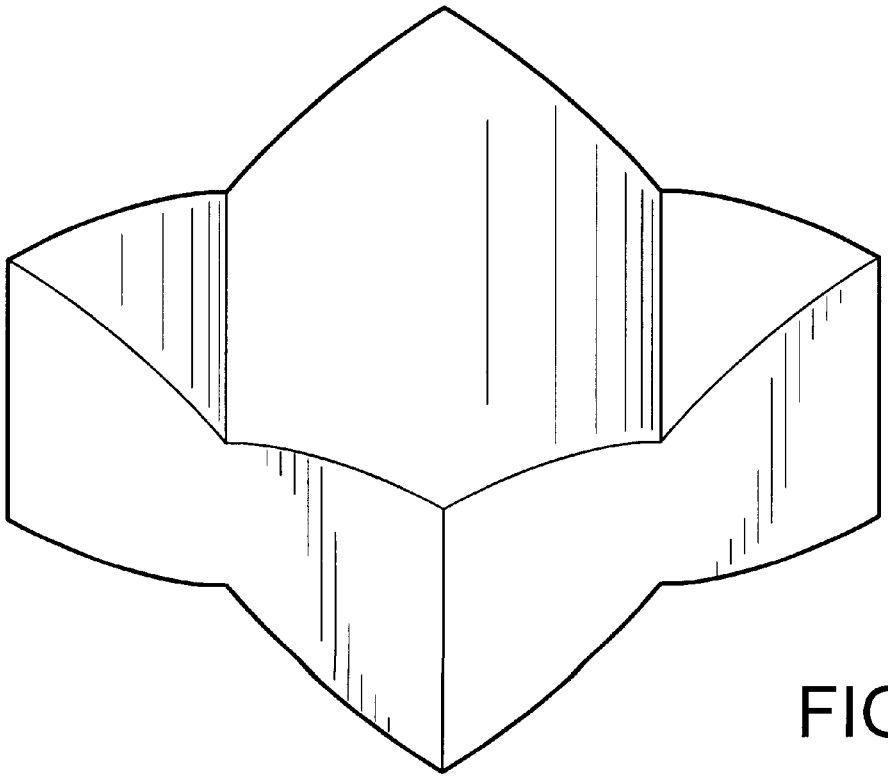
FIG. 4 is a view of a block in an alternative embodiment of the invention.

FIG. 4 illustrates an alternative embodiment of an individual block. Blocks of this configuration are arranged in a "diamond" configuration where each edge of each block is at 45° to the vertical axis if the block is substantially square. The angle may vary if the block is not square but is more of a parallelogram. In this embodiment, the cable grooves again follow the vertical axis and overlap horizontally adjacent blocks. Other alternative configurations of the blocks and the subpanels may be possible; it is intended that all such alternatives by encompassed by the claims herein.

Figure 7:
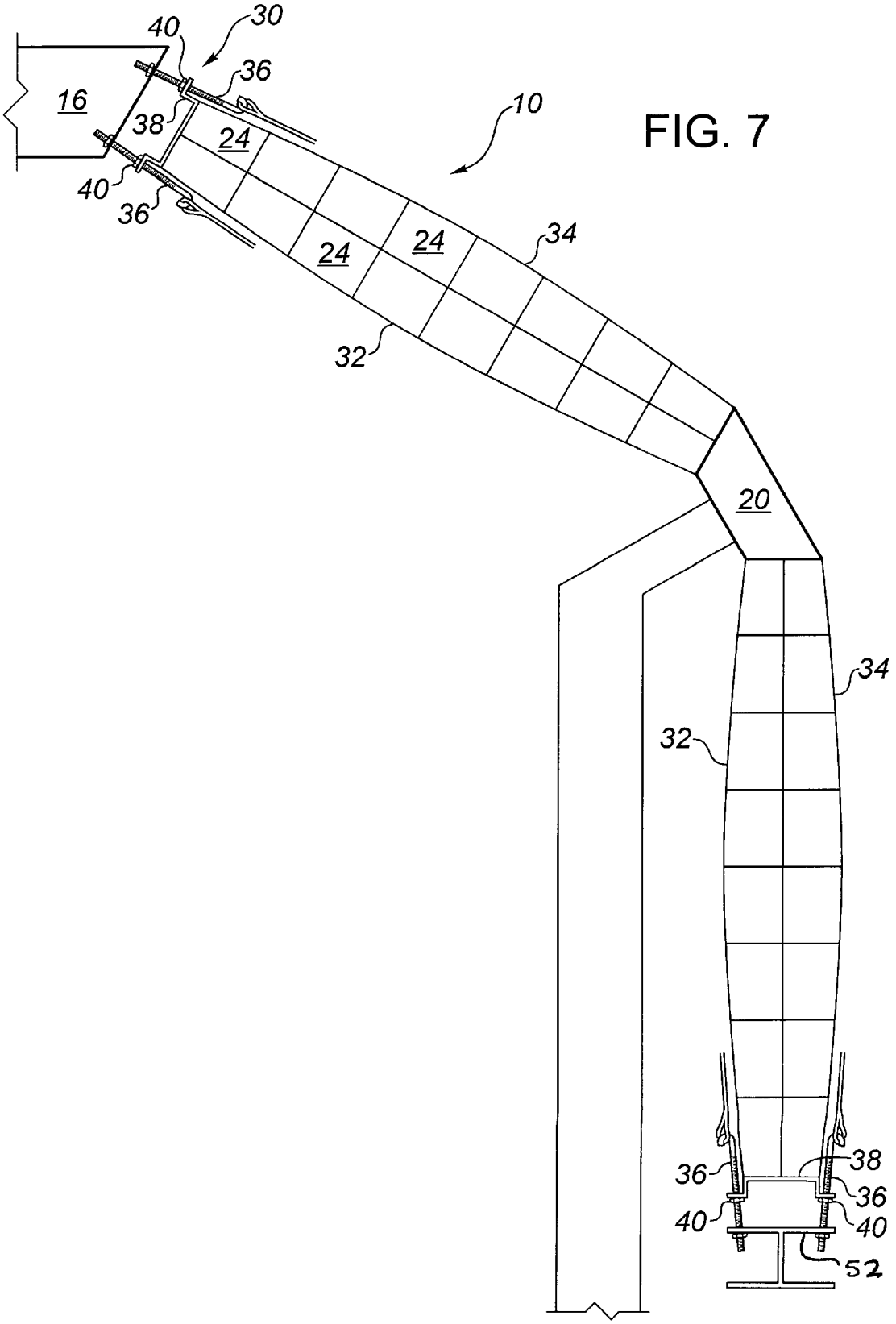
FIG. 7 is a cross sectional view of an assembled roof panel and wall panel.
Figure 8:
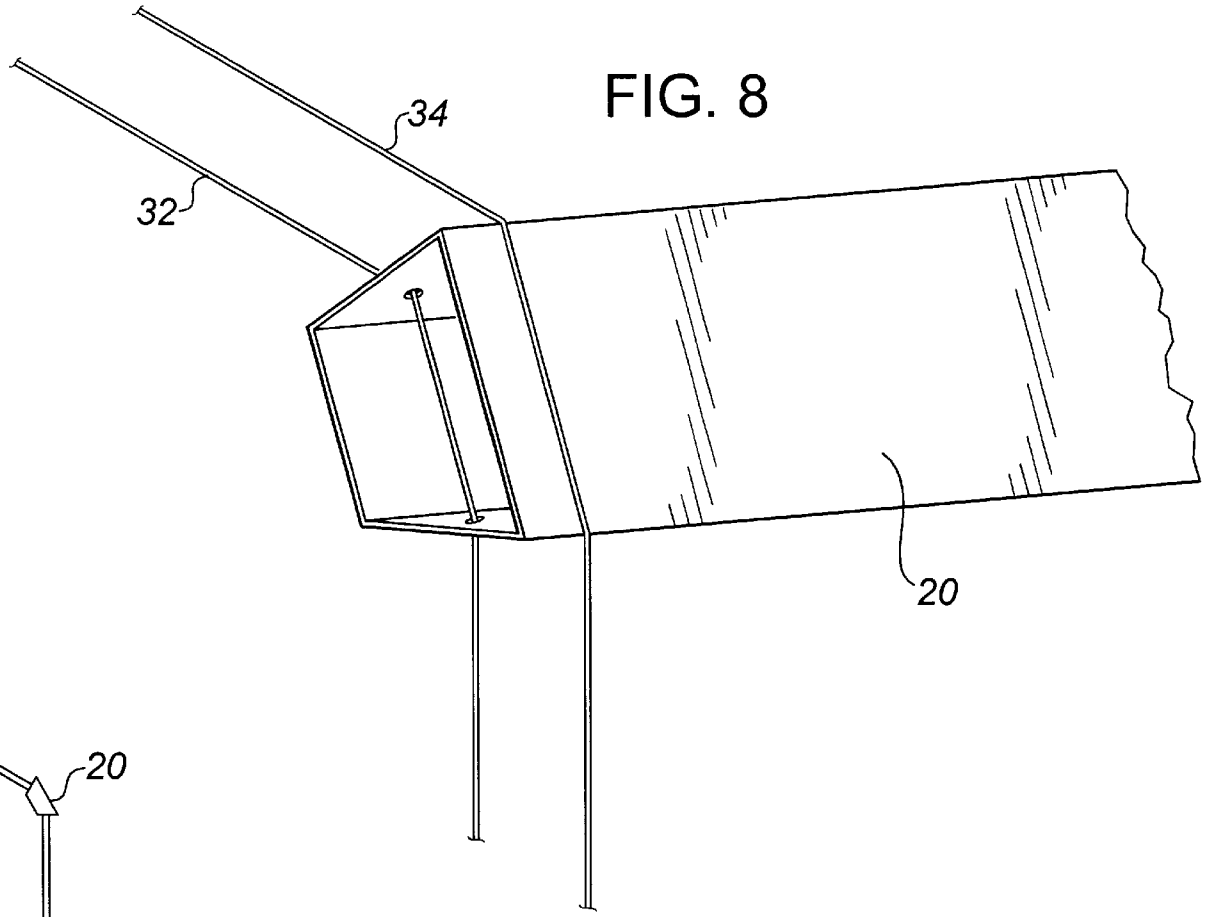
FIG. 8 is a cutaway view of the lower roof beam.
Figure 8A:
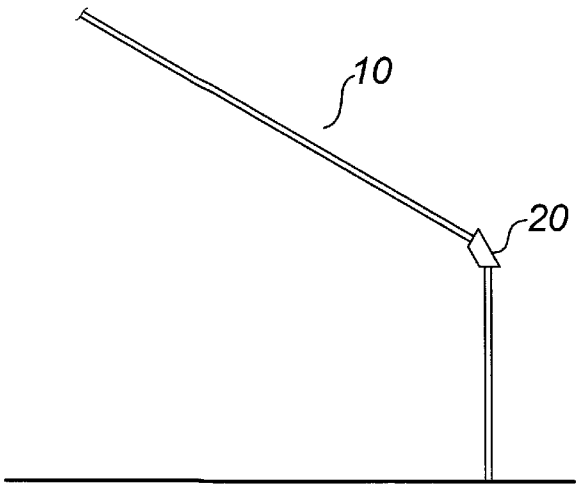

The subpanels (24) may also be used to form a wall panel (50) as shown in FIG. 7. In that case the cables (32, 34) may run from the apex beam (16) to a lower wall beam (52) with tensioning plates (38) and hooks (36) at both ends. Tensioning plates (38) and hooks (36) will not be necessary along the lower roof beam (20) as long as the inner cables (32) pass through the lower roof beam (20) and the outer cables (34) pass over the lower roof beam (20), as shown in FIG. 8. When the cables (32, 34) are tightened, the lower roof beam (20) will act like a tensioning plate to squeeze the blocks (24) together into a subpanel (22).

Figure 9:
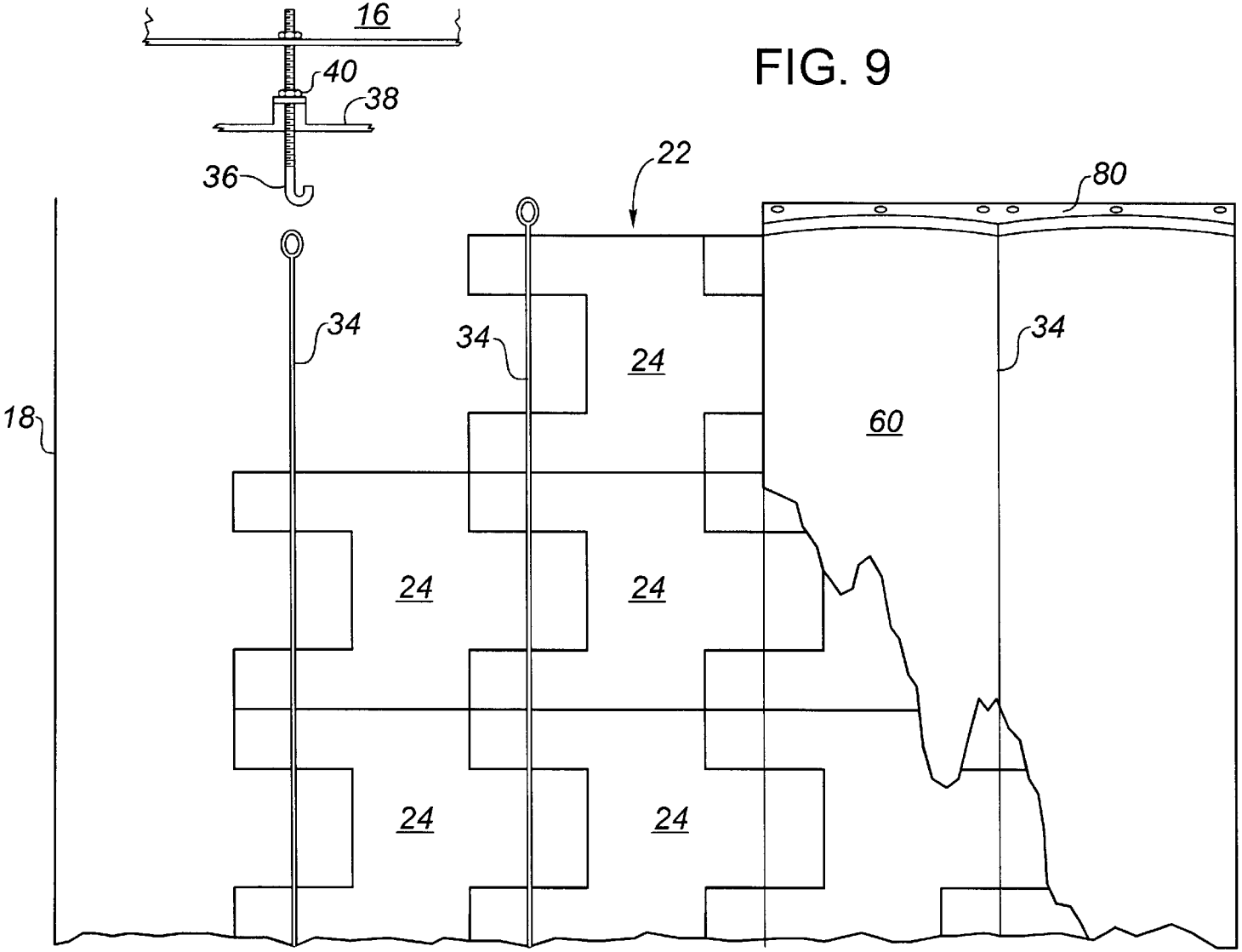
FIG. 9 is a view of the roof panel.

In order to weatherproof the roof panel (10), it may be necessary to layer a weatherproof fabric or sheet (60) over the panel (10), as shown in FIG. 9. Such a sheet (60) may be held in place by the outer cables (34). In the preferred embodiment, polyethylene sheeting is used. Alternatively, any fabric that is weatherproof and has high resistance to tearing will work.

The preferred embodiment of the invention is assembled using the following method. The groundwork is prepared and levelled in a conventional fashion on the chosen site. A suitable foundation (70) is laid and vertical supports (12, 14) are bolted or set into the foundation (70) to bear the load of the finished structure and any anticipated external forces such as wind and snow accumulation. The vertical supports (12, 14) may be braced as necessary. The apex beam (16), the end beams (18) and the lower roof (20) and wall beams (56) are then secured to the vertical supports (12, 14) to finish the building frame.

Once the building frame is complete, the tensioning plates (28) are affixed to the beams (16, 20) along with the lower tensioning hooks (36). All of the inner tensioning cables (32) are then laid and are tightened somewhat but not fully. The interlocking subpanels (22) may then be laid across the inner cables (32) to form the roof panel (10). The gap between the subpanels (22) and the lower roof beam (20) is covered by flashing preferably made of galvanized sheet metal (not shown).

Figure 10:
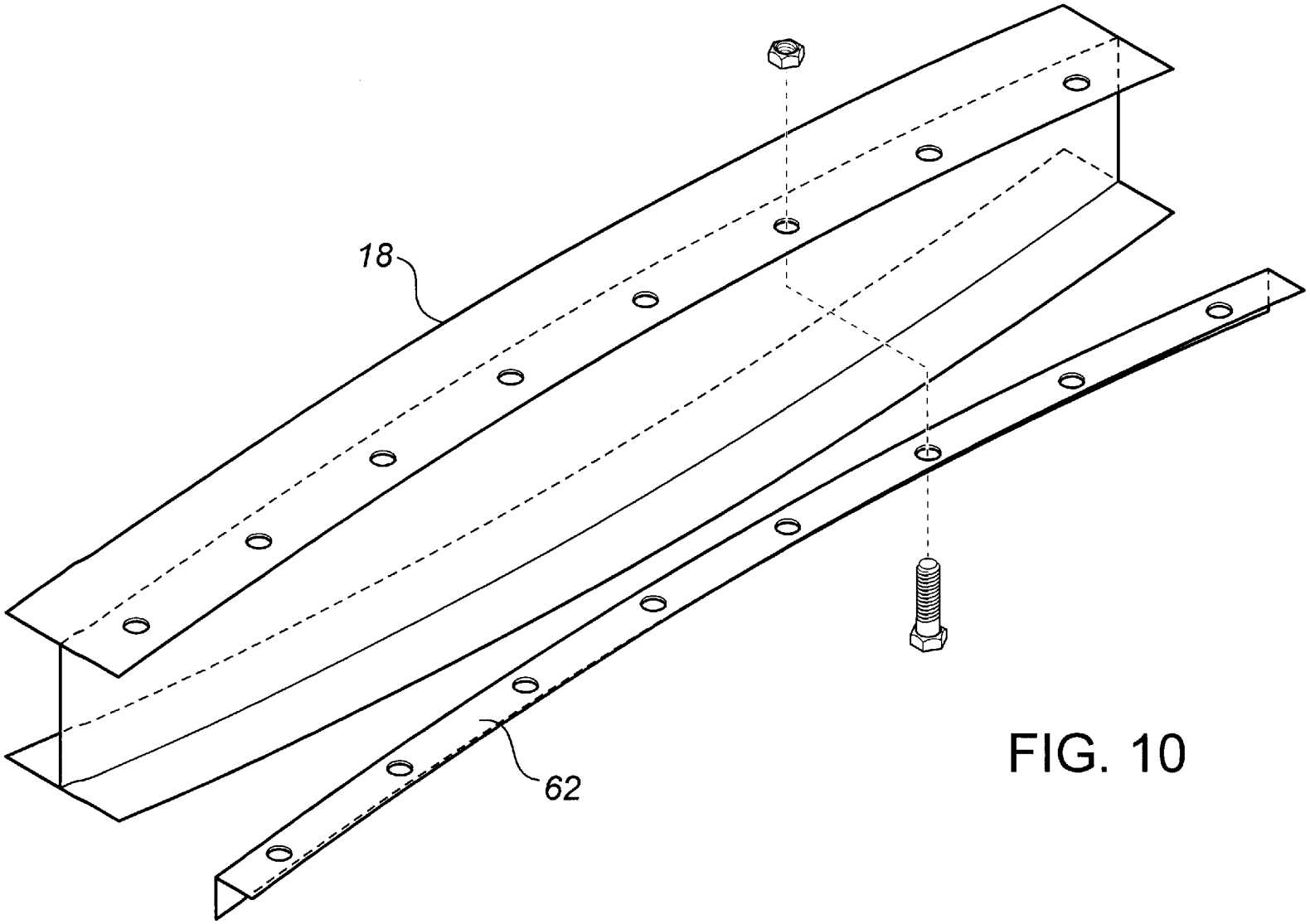
FIG. 10 is a view of the end beams of the preferred embodiment.

Next, the fabric sheet (60) is laid across the roof panel (10) and secured along its horizontal edges to the end beams (18). The sheet (60) may be secured to the end beams (18) by an angled bar (62) which is used to sandwich the sheet (60) to the end beam (18), as shown in FIG. 10. The upper and lower edges of the sheet (60) need not be secured as the tightened outer cables (34) will securely keep the sheet (60) in place. Once the fabric sheet is in place, the outer tensioning cables and hooks may be attached to the tensioning plates and roof beams. The inner and outer cables are then tensioned simultaneously.

Figure 11:
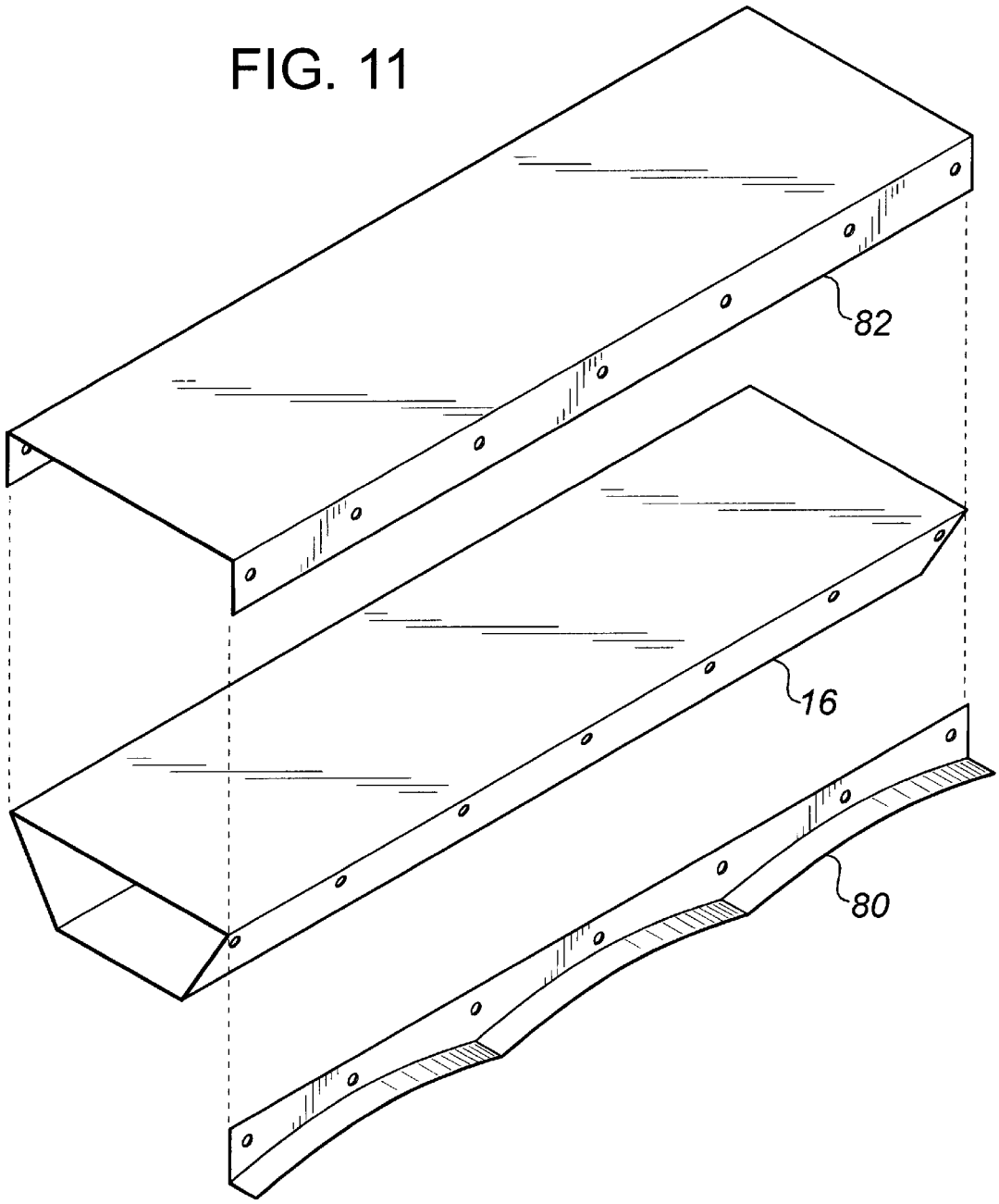
FIG. 11 is an exploded view of the apex flashing.

Once the roof panel (10) is completely formed, the last step is to weatherproof the apex of the roof by using galvanized sheet metal flashing as illustrated in FIG. 11. Flashing (80) shaped to conform to the corrugations of the roof panel (10) are attached to the apex beam (16) to bear down snugly on the sheet (60). A top piece (82) is then used to cover the apex beam (16) and the corrugated flashing (80).

Variations and modifications of the disclosed preferred embodiment and alternative embodiments will be apparent to skilled practitioners. All such variations and modifications are intended to be encompassed by the claims set forth herein.

The embodiments of the invention in which an exclusive property or privilege is claimed are defined as follows:

1. In a building structure, a construction panel having a longitudinal dimension and a lateral dimension, comprising a plurality of sub-panels, each sub-panel having a first end and a second end separated by said longitudinal dimension, and comprising:

(a) a plurality of blocks aligned longitudinally and abutting one another; and (b) stressing means associated with each sub-panel for maintaining the blocks in longitudinal alignment and for creating a longitudinal compressive force in the sub-panel causing the blocks in each sub-panel to act monolithically; wherein the sub-panels are arranged and abut one another laterally, and wherein each sub-panel has a convex outer surface and a convex inner surface, the convexity of said surfaces being apparent when the sub-panel is viewed laterally in cross-section.

2. The construction panel of claim 1, wherein the stressing means comprises, in association with each sub-panel, an outer cable and an inner cable passing in longitudinal orientation along the outer and inner surfaces respectively of the sub-panel, said cables extending between and being anchored to anchor frames associated with said first and second ends of the sub-panel, wherein both cables are tightened.

3. The construction panel of claim 2 wherein the blocks are formed of expanded polystyrene.

4. The construction panel of claim 2 wherein each subpanel interlocks with each of its neighbouring subpanels by means of a series of projections and channels shaped to receive the projections of an adjacent subpanel.

5. The construction panel of claim 4 wherein a longitudinal cable groove is formed on each of the outer and inner surfaces, each groove overlapping the projections of one subpanel and the body of the adjacent subpanel such that the stressing means assists in attaching one subpanel to the immediately adjacent subpanel.

6. In a building structure, a construction panel having a longitudinal dimension and a lateral dimension, and having a first end and a second end separated by said longitudinal dimension, said panel comprising:

(a) a plurality of blocks fitted together to form the panel;

(b) wherein each block is shaped such that the panel, when viewed laterally in cross-section has a convex outer surface and a convex inner surface; and (c) at least two anchor plates associated with said first and second ends of the panel; and (d) a plulurality of tensioned cables running longitudinally along said outer surface and inner surface;

wherein the panel acts monolithically as a result of a compressive force in the panel created by the tensioned cables and the interlocking blocks.

7. The construction panel of claim 6 wherein the blocks are substantially aligned in longitudinal rows, each row interlocks with the immediately adjacent row or rows, and the tensioned cables are located in the area of overlap between rows.

8. The construction panel of claim 6 wherein the blocks are formed of expanded polystyrene.

* * * * *

UNITED STATES PATENT AND TRADEMARK OFFICE

CERTIFICATE OF CORRECTION

PATENT NO. : 6,119,418
DATED : September 19, 2000
INVENTOR(S) : David Johnston

It is certified that error appears in the above-identified patent and that said Letters Patent is hereby corrected as shown below:

Title page,
Item [75], Inventor, change inventor to read -- David Johnston --

Signed and Sealed this

Twenty-third Day of July, 2002

*Attest:*

*Attesting Officer*

JAMES E. ROGAN
*Director of the United States Patent and Trademark Office*